United States Patent [19]

Sconce

[11] 4,303,112

[45] Dec. 1, 1981

[54] LOG SPLITTER AND SPLIT WOOD LOADER

[76] Inventor: Leonard S. Sconce, RR #1, Grafton, Ill. 62037

[21] Appl. No.: 115,561

[22] Filed: Jan. 21, 1980

[51] Int. Cl.[3] ..... B27L 7/00

[52] U.S. Cl. ..... 144/193 A

[58] Field of Search ..... 144/3 K, 193 R, 193 A

[56] References Cited

U.S. PATENT DOCUMENTS

| | | | |
|---|---|---|---|
| 3,280,864 | 10/1966 | Spanenberg | 144/193 A |
| 3,319,675 | 5/1967 | Bles, Sr. | 144/193 A |
| 3,596,691 | 8/1971 | Broadfoot | 144/193 A |
| 3,760,854 | 9/1973 | Worthington et al. | 144/193 A |
| 3,938,567 | 2/1976 | Dircksen et al. | 144/193 A |
| 4,076,061 | 2/1978 | Greeninger | 144/3 K |
| 4,160,470 | 7/1979 | Sigmund | 144/3 K |
| 4,164,965 | 8/1979 | Bodart | 144/3 K |
| 4,173,237 | 11/1979 | Heikkinen et al. | 144/3 K |

*Primary Examiner*—W. D. Bray
*Attorney, Agent, or Firm*—Harvey B. Jacobson

[57] ABSTRACT

A wheeled trailer frame is provided including front and rear ends and equipped with a forwardly projecting tongue for releasable coupling to and support from a draft vehicle. A rearwardly and upwardly inclined elongated guide structure is supported from the frame and an upstanding forwardly facing splitting wedge is supported from the rear portion of the guide structure. A pressure member is supported on the guide structure forward of the wedge for guided movement along the guide structure toward and away from the wedge and power structure is operatively connected between the frame and the pressure member for moving the latter along the guide structure toward the wedge. The guide structure has elongated trough structure supported relative thereto defining a trough extending along and having the guide structure as its bottom. The trough structure extends both to the front and rear of the wedge and includes a transverse portion rearward of the guide structure forming a continuation thereof. The rear upper end of the trough structure is spaced between four and five feet rearward of the wedge and at an elevation of approximately five feet above a horizontal surface upon which the wheels of the trailer and the tongue of the trailer rest.

10 Claims, 5 Drawing Figures

LOG SPLITTER AND SPLIT WOOD LOADER

BACKGROUND OF THE INVENTION

Various forms of log splitting trailers and other similar devices heretofore have been designed such as those disclosed in U.S. Pat. Nos. 3,938,567, 3,974,867, 4,076,061, 4,120,334 and 4,141,396. However, these previously known forms of log splitting devices are not particularly well suited for trailing into wooded areas where trees have been felled and their trunk and limb portions have been cut into desired lengths for subsequent splitting. In addition, these previously known forms of log splitting devices, if equipped with structure for loading split leg sections into a vehicle load bed, are complex and expensive to market.

Accordingly, a need exists for a trailable log splitter of simple design and which may be utilized in conjunction with a vehicle supported load bed to load split log sections into the load bed as a continuation of the log section splitting process.

Another object of this invention is to provide a log splitter in accordance with the preceding object and constructed in a manner whereby the split log section elevating and conveying feature thereof requires no additional power other than the power supplied to the hydraulic ram of the log splitter.

A further important object of this invention is to provide a log splitter which may be readily transported to remote wooded locations.

Still another important object of this invention is to provide a log splitter in the form of a trailer and which may therefore be trailed behind a load bed equipped vehicle to and from the wooded log splitting and split log section loading location.

Yet another object of this invention is to provide a log splitter including convenient support surfaces thereon for supporting large split half log sections preparatory to further splitting of the larger half log sections into smaller quarter log sections.

A final object of this invention to be specifically enumerated herein is to provide a log splitter of the trailer type in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
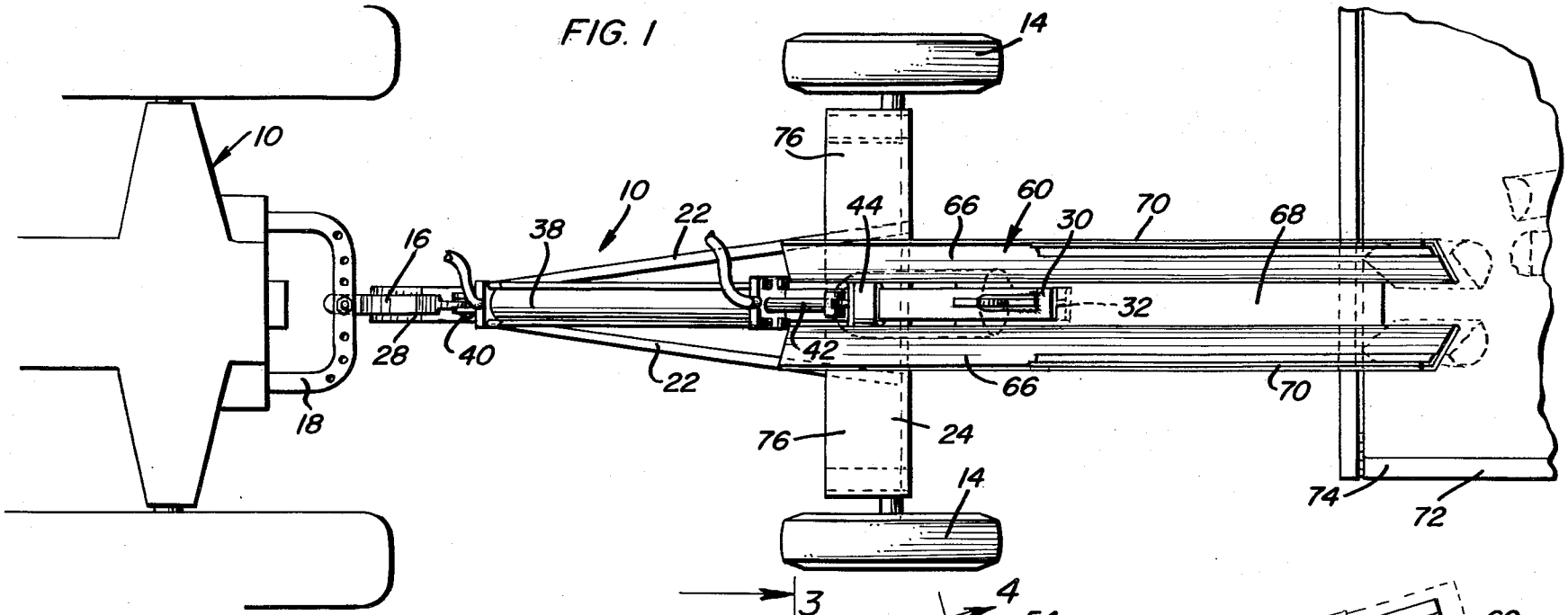
FIG. 1 is a top plan view of the log splitter and split wood loader of the instant invention.
Figure 2:
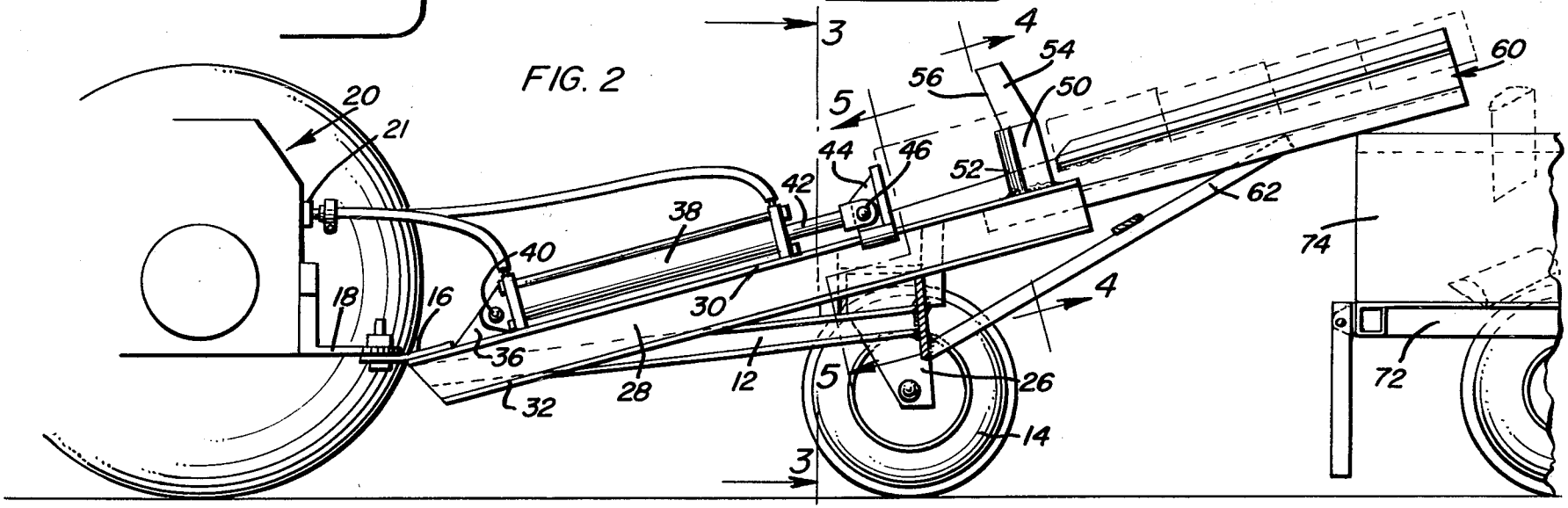
FIG. 2 is a side elevational view of the assemblage illustrated in FIG. 1 and with the near side wheel broken away.
Figure 3:
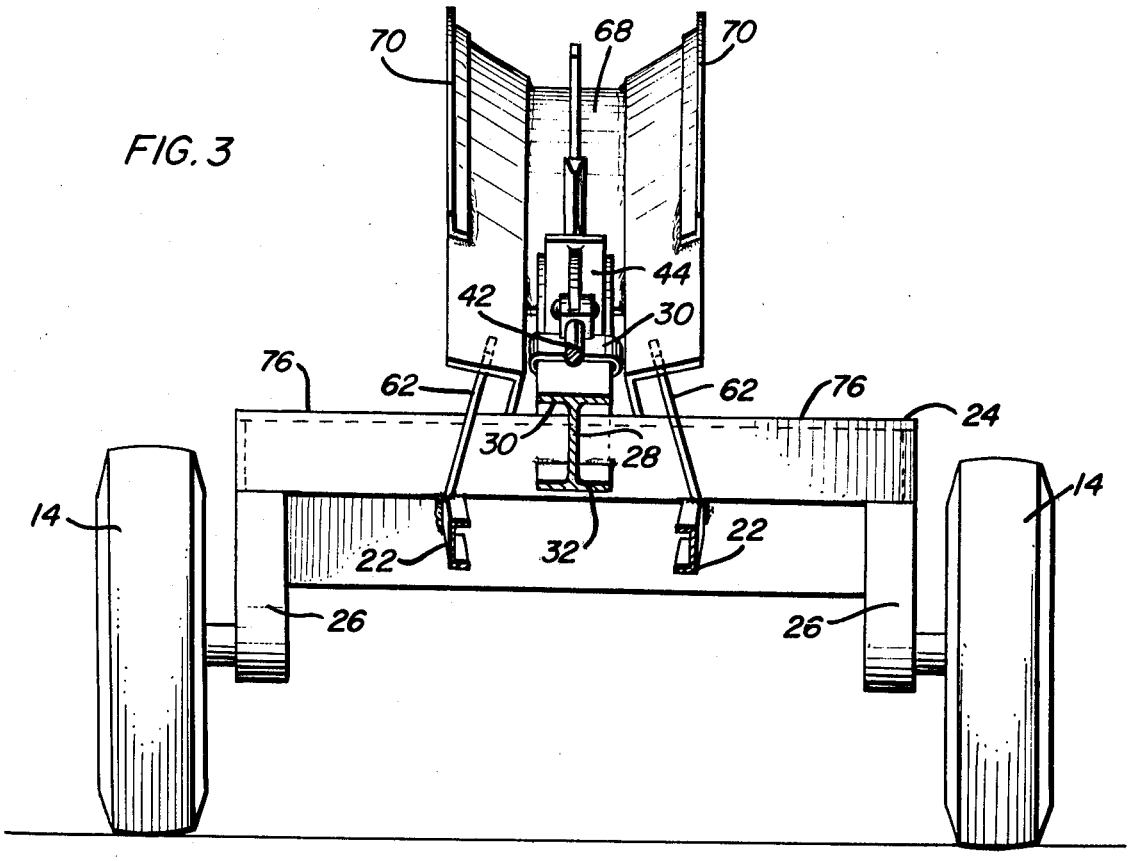
FIG. 3 is an enlarged transverse vertical sectional view taken substantially upon the plane indicated by the section line 3—3 of FIG. 2.
Figure 4:
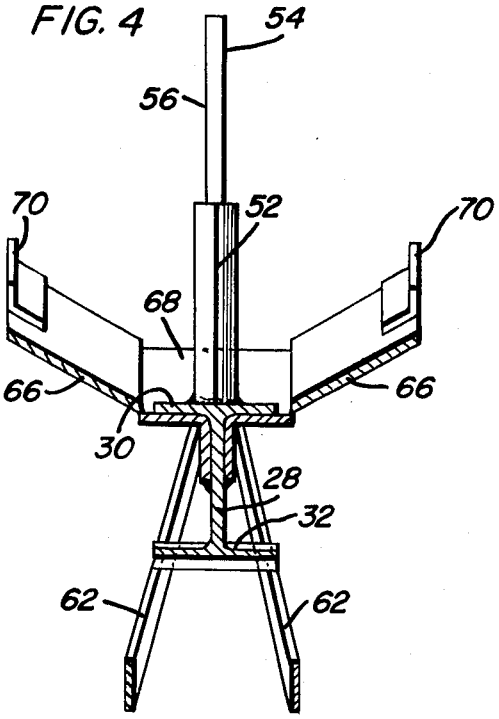
FIG. 4 is an enlarged transverse sectional view taken substantially upon the plane indicated by the section line 4—4 of FIG. 2.
Figure 5:
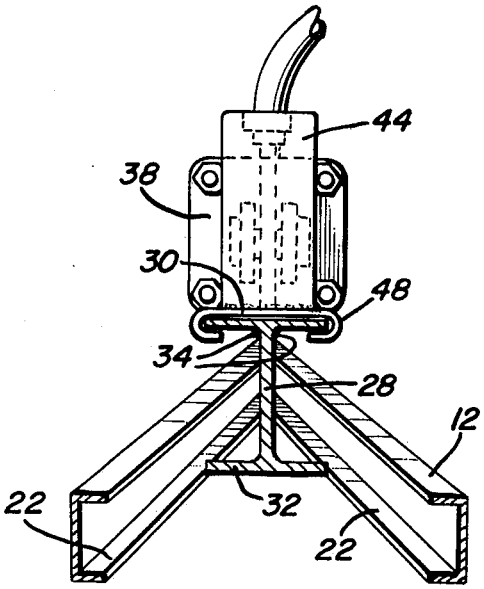
FIG. 5 is an enlarged transverse sectional view taken substantially upon the plane indicated by the section line 5—5 of FIG. 2.

Referring now more specifically to the drawings, the numeral 10 generally designates the log splitter and split wood loader assembly of the instant invention. The assembly 10 includes a wheeled frame 12 having front and rear ends. The rear end of the frame 12 dependingly supports a pair of opposite side support wheels 14 therefrom and the forward end of the frame 12 includes a tow hitch 16 for releasable coupling to a hitch structure 18 on a draft vehicle referred to in general by the reference numeral 20, the draft vehicle 20 comprising a farm tractor including a source 21 of hydraulic fluid under pressure.

The frame 12 includes a pair of rearwardly divergent longitudinal members 22 interconnected by a transverse bracing structure 24 extending and secured therebetween. The opposite ends of the transverse bracing structure 24 extend outwardly beyond the remote sides of the rear ends of the longitudinal members 22 and include depending portions 26 from which the wheels 14 are journaled.

The assembly 10 further includes an elongated longitudinally extending guide structure 28 in the form of an I beam including upper and lower flanges 30 and 32. The forward ends of the longitudinal members 22 are secured to the forward ends of the I beam 28 as at 34 and the forward end of the I beam 28 has an apertured mount 36 mounted on the upper flange 30 thereof. The base end of a double acting hydraulic cylinder 38 is pivotally anchored to the mount 36 as at 40 and the hydraulic cylinder 38 extends longitudinally rearwardly of the mount 36 and includes a rearwardly extendible and forwardly retractable piston shaft portion 42 on whose outer rear end a pressure abutment member 44 is mounted as at 46. The pressure abutment member 44 includes a base portion 48 which embracingly and guidingly engages the upper flange 30 of the I beam 28 and the upper rearward end of the upper flange 30 includes a first forwardly facing wedge 50 supported therefrom. The wedge 50 defines a forwardly facing upstanding edge 52 which is slightly forwardly and upwardly inclined relative to a plane normal to the longitudinal extent of the I beam 28 and a second upstanding wedge 54 is mounted atop the wedge 50 and includes a forwardly facing upstanding edge 56 which is also forwardly and upwardly inclined relative to the aforementioned plane. However, the inclination of the edge 56 relative to a plane normal to the longitudinal extent of the I beam 28 is greater than the inclination of the edge 52. Further, the lower end of the edge 56 is stepped rearwardly of the upper end of the edge 52.

A trough assembly referred to in general by the reference numeral 60 is supported from the transverse bracing structure 24 on opposite sides of the upper end portion of the I beam 28 and generally parallels and forms an upward continuation of the upper end of the upper flange 30 of the I beam 28. The upper end of the trough assembly 60 is braced relative to the depending portions 26 by forwardly and downwardly divergent bracing members 62. The trough assembly 60 includes a pair of oppositely upwardly and outwardly inclined sides 66 disposed on opposite sides of and spaced slightly outwardly of the upper end portion of the upper flange 30 of the guide structure 28. The sides 66 continue rearwardly and upwardly beyond the rear upper end of the I beam 28 and are joined along their adjacent marginal edges rearwardly of the flange 30 by a trough bottom 68 extending and secured therebetween and forming an upward continuation of the upper flange 30 of the I beam 28. Also, the remote marginal portions of the upper end portions of the sides 66 include vertically upwardly directed flanges 70.

In operation, the assembly 10 may be coupled to and trailed behind the hitch structure 18 to a wooded area having cut log lengths therein. The assembly 10 may be retained coupled to the hitch structure 18, or may be released from engagement therewith in order that the forward end of the I beam 28 may rest upon the ground from which the wheels 14 are supported. Further, the assembly 10 may be trailed to the aforementioned wooded area behind the vehicle 72 upon which the split log sections are to be loaded, if that vehicle is provided with a source of hydraulic fluid under pressure or the assembly 10 is provided with a self-contained source of fluid under pressure. In operation, the cylinder 38 is operated to retract the piston shaft portion 42 and a log section to be split is placed within the trough assembly 60 between the pressure abutment 44 and the wedge 50. Then the cylinder 38 is actuated to extend the piston shaft portion 42 whereupon the pressure abutment 42 will force the log section into engagement with and past the wedge 50.

The inclination of the edge 52 of the wedge 50 serves to maintain the log section being split in contact with the upper flange 30 of the I beam 28. However, should the log section not be cylindrical or the end cut thereon not be square and the log section to be split has a tendency to be cammed upwardly at its upper end during the initial log section splitting operation, the upwardly cammed portion of the log section to be split will engage the more inclined edge 56 of the wedge 54 to insure that the log section being split will be retained in engagement with the upper flange 30 of the I beam 28. As each log section is split, the split sections pass upwardly past the wedge 50 on opposite sides thereof and are cradled in the upper portion of the through assembly 60 disposed above the wedge 50. When the next log section is placed between the lower pressure abutment 44 and the wedge 50 and subsequently split by upward movement of the pressure abutment 44, its split sections will engage the previously split sections and convey the latter rearward and upwardly along the trough assembly 60. This upward conveying of the split log sections along the trough assembly 60 will continue until such time as the uppermost log sections within the trough assembly 60 are pushed from the upper rear end of the trough for falling into the load bed 74 of the vehicle 72. The assembly 10 thus may be seen to be operative not only to split log sections, but to also upwardly convey the log sections for subsequent dropping into a vehicle load bed independent of an additional power source to power a conveyor mechanism.

The upper surface portions of the opposite ends of the elongated transverse bracing structure 24 define horizontal tables 76 upon which half sections of large logs split by the wedge 50 may be placed during retraction of the pressure abutment 44 in order that each of the half log sections may again be placed between the pressure abutment 44 and the wedge 50 for further splitting.

The upper rear end of the trough assembly 60 extends generally four to five feet to the rear of the wedge 50 and to an elevation of substantially five feet when the forward end of the tongue is disposed at the level of the lower surfaces of the wheels 14, whereby split logs may be discharged directly into the load bed 74.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a wheeled trailer frame, said frame including front and rear ends and a forwardly projecting tongue for releasable coupling to a draft vehicle, an elongated guide structure supported from and extending longitudinally of said frame, an upstanding forwardly facing splitting wedge support from the rear portion of said guide structure, a pressure member supported on said guide structure forward of said wedge for guided movement along said guide structure toward and away from said wedge, power means operatively connected between said frame and pressure member for moving the latter said guide structure toward said wedge, said guide structure having elongated trough structure supported relative thereto defining trough means extending therealong with a portion of said guide structure defining the bottom of said trough structure, said trough structure extending both to the front and rear of said wedge.

2. The combination of claim 1 wherein said wedge includes a forwardly facing substantially straight upstanding apex edge upwardly and forwardly inclined, slightly, toward the forward end of said frame relative to a plane normal to the longitudinal extent of said guide structure.

3. The combination of claim 2 wherein a second upstanding wedge supported atop the first mentioned wedge and also including a forwardly facing substantially straight upstanding apex edge upwardly forwardly inclined relative to said plane, said second wedge apex being more inclined relative to said plane than the first mentioned apex edge.

4. The combination of claim 1 wherein said elongated guide structure and elongated trough structure are rearwardly and upwardly inclined.

5. The combination of claim 4 wherein the rear end of said trough structure extends generally four to five feet to the rear of said wedge and to an elevation of substantially five feet when the forward end of said tongue is disposed at the level of the lower surfaces of the wheels of said frame.

6. The combination of claim 1 wherein said frame includes a pair of horizontally outwardly projecting platforms disposed on opposite sides of said guide structure and spaced slightly forward of said wedge, said platforms defining horizontal upper support surfaces when the forward end of said tongue is disposed at the level of the lower surfaces of the wheels of said frame.

7. The combination of claim 6 wherein said elongated guide structure and elongated trough structure are rearwardly and upwardly inclined.

8. The combination of claim 7 wherein the rear end of said trough structure extends generally four to five feet to the rear of said wedge and to an elevation of substantially five feet when the forward end of said tongue is disposed at the level of the lower surfaces of the wheels of said frame.

9. The combination of claim 8 wherein said wedge includes a forwardly facing substantially straight upstanding apex edge upwardly and forwardly inclined, slightly, toward the forward end of said frame relative to a plane normal to the longitudinal extent of said guide structure.

10. The combination of claim 9 wherein a second upstanding wedge supported atop the first mentioned wedge and also including a forwardly facing substantially straight upstanding apex edge upwardly forwardly inclined relative to said plane, said second wedge apex edge being more inclined relative to said plane than the first mentioned apex edge.

* * * * *